United States Patent [19]

Rainer et al.

[11] Patent Number: 4,481,958

[45] Date of Patent: Nov. 13, 1984

[54] COMBUSTIBLE CARBON FILTER AND SMOKING PRODUCT

[75] Inventors: Norman B. Rainer; Gus D. Keritsis, both of Richmond, Va.

[73] Assignee: Philip Morris Incorporated, New York, N.Y.

[21] Appl. No.: 296,233

[22] Filed: Aug. 25, 1981

[51] Int. Cl.[3] ..... A24D 1/18; A24D 3/00; A24D 3/02; A24D 3/06

[52] U.S. Cl. ..... 131/331; 131/334; 131/359; 131/364; 131/369

[58] Field of Search ..... 131/331, 340, 341, 342, 131/343, 344, 345, 359, 369, 334, 364

[56] References Cited

U.S. PATENT DOCUMENTS

| | | | |
|---|---|---|---|
| 2,987,686 | 10/1959 | Siegel | 131/359 |
| 3,943,941 | 3/1976 | Boyd et al. | 131/359 |
| 4,044,777 | 8/1977 | Boyd et al. | 131/359 |
| 4,079,742 | 3/1978 | Rainer et al. | 131/359 |
| 4,219,031 | 8/1980 | Rainer et al. | 131/359 |
| 4,256,123 | 3/1981 | Lenduay et al. | 131/359 |
| 4,256,126 | 3/1981 | Seligman et al. | 131/369 |
| 4,286,604 | 9/1981 | Ehretsmann et al. | 131/369 |

FOREIGN PATENT DOCUMENTS

| | | | |
|---|---|---|---|
| 859399 | 4/1978 | Belgium | 131/369 |
| 1100745 | 5/1981 | Canada | 131/369 |
| 2744728 | 10/1977 | Fed. Rep. of Germany | 131/369 |
| 2366807 | 10/1977 | France | 131/369 |
| 21655 | 10/1964 | Japan | 131/342 |
| 23970 | 10/1968 | Japan | 131/342 |
| 23980 | 10/1968 | Japan | 131/342 |
| 1023918 | 3/1966 | United Kingdom | 131/342 |
| 1033818 | 6/1966 | United Kingdom | 131/342 |
| 2064293 | 9/1980 | United Kingdom | 131/342 |

*Primary Examiner*—V. Millin

*Attorney, Agent, or Firm*—Jeffrey H. Ingerman

[57] ABSTRACT

The present invention provides a method according to which a cellulose rod, at least 11 mm in diameter and formed from cellulosic paper made by the wet papermaking process, that has been treated with a binding agent, repeatedly folded along its longitudinal axis and passed through a heated forming die to provide a coherent rod, is treated with an additive and then pyrolyzed by being advanced through a die maintained at a temperature within the range of from about 500° C. to about 1000° C. in an oxygen-free atmosphere for a total retention time in the die of from about 3 seconds to about 1 minute. The pyrolyzed cellulose rod is then cooled to less than about 250° C. before being removed from the oxygen-free atmosphere. The resulting combustible carbonized rod may be cut to suitable lengths and employed as a filter in tobacco-containing cigarettes or may be used to form a tobacco-free cigarette.

13 Claims, 4 Drawing Figures

FIG. 1
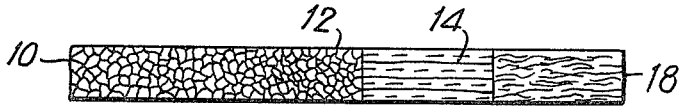
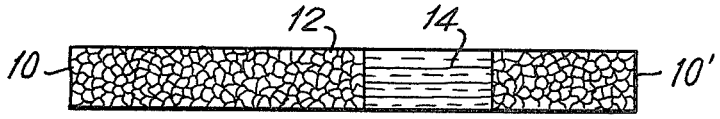
FIG. 2
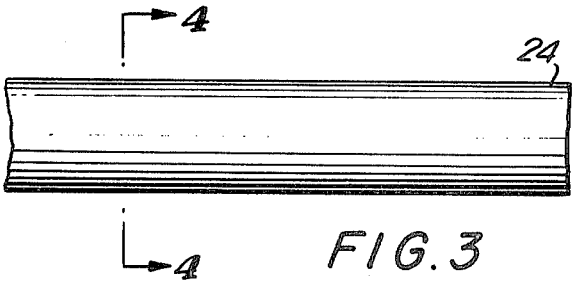
FIG. 3
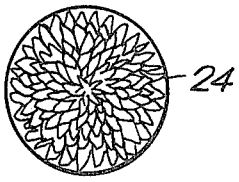
FIG. 4

COMBUSTIBLE CARBON FILTER AND SMOKING PRODUCT

BACKGROUND OF THE INVENTION

The present invention relates to filters for smoking products and to smoking products. More particularly, the present invention relates to a combustible carbon filter and smoking product, as well as to methods for their manufacture.

The use of carbonized matter as a partial or total substitute for the customary tobacco shred content of cigarettes and as a filter or filtration enhancer have been reported as have various methods for manufacturing such cigarettes and filters.

In the selection of carbonized matter for processing with tobacco, much attention has been directed to the selection of fiber dimension. When blending tobacco shreds and fine-dimensioned carbon fibers, gravimetric sedimentation results which, in turn, results in an uncontrolled decrease in the initial carbon content, giving rise to blend inconsistency. Processing of brittle, thin fibers also leads to the formation of dust-like carbon particles which can either fall out of the blend or agglomerate in and clog a conventional cigarette filter. Although a graphitization treatment of carbon fibers will overcome their brittleness, this practice tends to be prohibitively expensive and still does not fully overcome the adverse effect of sedimentation. Since the composition of such blends is not constant during processing, difficulties are encountered in the recovery and reuse of filler from off-standard cigarettes.

Gravimetric sedimentation of carbon in blend processing is avoided by selection of large-sized carbon fibers, such as may be derived from the carbonization of wood shreds (i.e. excelsior) having an average diameter of one millimeter. Carbon fibers present in the formed blended cigarette rod having a thickness greater than 0.3 millimeter generate fiery particles which drop freely from the cigarette coal during smoking.

The aforementioned difficulties encountered in processing a blend of tobacco shreds and carbonized matter, particularly sedimentation, are seemingly avoided by the formation of cigarettes made entirely of carbonaceous matter. However, the heretofore known practices for making smoking products entirely of carbonaceous matter tend to result in a product having porosity that is considerably lower than the porosity of conventional tobacco-containing cigarettes. As a consequence, the resistance-to-draw of the rod is excessively high. Further, these heretofore known practices tend to suggest the use of carbonized rod structures containing large-sized structural elements which, upon burning, generate the aforementioned fiery particles. Such rod structures are also difficult to cut to lengths suitable for use in the manufacture of cigarettes.

DEFINITIONS

Carbonized

Carbonized is used herein to denote that during pyrolysis the cellulose is converted to a substance that, by elemental analysis, consists of at least 80 percent carbon exclusive of ash-forming ingredients.

Resistance-to-Draw (RTD)

RTD is determined as follows. A vacuum system is set to pull an air flow of 1050 cc/minute by inserting a standard capillary tube through the dental dam of a cigarette holder and adjusting the reading on an inclined water manometer to the correct RTD. Then the butt end of a cigarette is inserted to a depth of 5 mm in the dental dam of the cigarette holder. The pressure drop behind this cigarette with 1050 cc/minute of air flowing through is read directly as RTD in inches of water.

Total Particulate Matter (TPM)

The particulate matter of tobacco smoke consists of minute liquid particles condensed from the vapor formed by the combusion of the cigarette and suspended in the smoke stream. These particles are collectively referred to as the total particulate matter, which for convenience may be referred to as "TPM". The TPM content of smoke is measured by determining the weight of material trapped on a Cambridge filter pad under standard machine-smoking conditions.

SUMMARY OF THE INVENTION

A method is provided for making a combustible carbonized rod according to which an unwrapped cellulose rod at least 11 mm in diameter and comprising a coherent bundle of cellulosic paper, which paper made by the wet paper-making process, is treated with an additive selected from the group of compounds consisting of $Na_2B_4O_7$, $CaCl_2$, $K_4Fe(CN)_6$, $Al_2(SO_4)_3$ and $Cu_2SO_4$ and mixtures thereof, so that the treated cellulose rod contains from about 1% to about 5% by weight of the additive on a dry weight basis. The treated rod is then pyrolyzed by being advanced through a die maintained at a treatment temperature within the range of from about 500° C. to about 1000° C. in an oxygen-free atmosphere for a total retention time in the die of from about 3 seconds to about 1 minute. The die is selected such that the pyrolyzed rod emerging therefrom has a diameter of from about 7 mm to about 9 mm. The pyrolyzed rod produced under the aforementioned treatment conditions, retains at least about 15% of the weight of the cellulose rod. The pyrolyzed rod is then cooled to less than about 250° C. before being removed from the oxygen-free atmosphere at which point it may be referred to as a combustible carbonized rod.

A method is also provided for making the cellulose rods employed in the preceding method according to which cellulosic paper made by the wet paper-making process is contacted with an aqueous solution of a binding agent and is then repeatedly folded, while wet, along its longitudinal axis to form a substantially cylindrical bundle which is then advanced through a heated die to remove the water and produce a coherent cellulose rod which maintains its integrity in the absence of any external wrapping. The die is selected such that the cellulose rod emerging therefrom has a diameter of at least about 11 mm.

The combustible carbonized rod may be cut to lengths of from about 10 mm to about 40 mm and employed as the filter or in addition to a conventional filter, such as a cellulose acetate (CA) filter, in a tobacco-containing cigarette or may be employed in conventional cigarette lengths of from about 85 mm to about 120 mm to formulate a tobacco-free cigarette.

BRIEF DESCRIPTION OF THE DRAWINGS

FIG. 1 is a sectional view through the longitudinal axis of a tobacco-containing smoking product showing a tobacco column 10 and both a combustible carbon filter 14 of the present invention and a conventional filter 18 enclosed in a conventional cigarette wrapping paper 12.

FIG. 2 is a sectional view through the longitudinal axis of a tobacco-containing cigarette showing a combustible carbon filter 14 of the present invention located between two tobacco columns 10 and 10' enclosed in a conventional wrapping paper 12.

FIG. 3 is a view of a segment of a continuous cellulose rod 24 of the present invention prior to being advanced through the pyrolyzing die.

FIG. 4 is a sectional view taken on line 4—4 of FIG. 3 and showing the internal geometry of the cellulose rod of the present invention.

DESCRIPTION OF PREFERRED EMBODIMENTS

The method of the present invention for making combustible carbonized rods for inclusion as filters in tobacco-containing smoking products such as cigarettes or for the production of smoking products that do not include tobacco (tobacco-free products) includes treating and then pyrolyzing a cellulose rod under controlled conditions of time, temperature and atmosphere to form a combustible carbonized rod.

The cellulose rods employed in the method of the present invention to make combustible carbon rods are made by contacting cellulosic paper with an aqueous-based binding agent and then repeatedly folding the wet paper along its longitudinal axis to form a compact, substantially cylindrical bundle which is then advanced through a heated forming die to remove the water and form a coherent cellulose bundle having a cylindrical shape and a diameter of at least about 11 mm, preferably from about 11 mm to about 17 mm and which maintains its integrity (i.e., its cylindrical shape) in the absence of any external wrapping, such as a paper wrapping.

The cellulosic paper employed to make the cellulose rods is a paper made from wood pulp by the wet papermaking process. This paper may be characterized as a substantially isotropic web. Suitable papers may be creped or smooth and have weights from about 5 to 40 grams per square meter. The use of synthetic cellulosic materials and the use of blends of synthetic cellulosic materials with cellulosic paper have been found to produce a rod which, when employed in the method of the present invention, produces a combustible rod which is inferior to the combustible rods produced from cellulosic paper produced from wood pulp by the wet papermaking process. The use of fabric and/or non-woven fabric as a cellulosic material does not result in a satisfactory combustible carbon rod when such rods are made according to the present method.

The aqueous-based binding agent is typically an aqueous solution of a water-soluble polymer such as polyfurfuryl. Preferably, the additive employed to increase the amount of carbon produced during pyrolysis, as discussed below, which additive is selected from the group of compounds consisting of $Na_2B_4O_7$, $CaCl_2$, $K_4Fe(CN)_6$, $Al_2(SO_4)_3$ and $Cu_2SO_4$ and mixtures thereof, is employed as the binding agent. When employed as the binding agent, the additive is employed in an amount such that the resultant cellulose rod contains from about 1% to about 5% by weight of the additive on a dry weight basis. As the binding agent, an aqueous solution of a water-soluble polymer, such as polyfurfuryl alcohol, or a latex may be either as the sole binding agent or in addition to the additive. However, the preferred binding agent is the additive or a combination of the additive and polymer.

When the water is removed during passage through the heated forming die, the polymer or additive binds the various layers produced by the repeated folding together into a coherent bundle. The combination of binder and heated forming die results in a coherent cylindrical bundle which eliminates the need for any wrapping material, such as paper, to hold the rod together. It has been found that the use of a wrapping material, especially paper, is detrimental to the formation of a satisfactory combustible carbonized rod when employing the method of the present invention.

The repeated folding of the cellulosic paper along its longitudinal axis is essential to the ultimate production of a satisfactory combustible carbon rod since the combustible carbon rod retains the micro-geometry of the cellulosic rod and this repeated folding along the longitudinal axis is believed to produce, in the combustible carbon rod, a pore volume which permits satisfactory smoking characteristics without sacrificing rod strength. The repeated folding along the longitudinal axis produces a geometry shown in FIG. 4 as a cross-section of a cellulose rod of the present invention.

The forming die is preferably substantially funnel-shaped although a tapered die may be employed. The substantially cylindrical portion of the funnel will have a diameter such that the formed cellulose rod emerging therefrom has a diameter of at least about 11 mm and preferably from about 11 mm to about 17 mm. The die is preferably metallic and is heated externally, for example, by thermostatically controlled electrical resistance elements. The temperature of the forming die is at least sufficient to effect removal of the water from the wet, folded cellulosic paper as it is advanced therethrough but is not otherwise particularly critical since a slight scorching of the cellulosic paper has not been observed to be detrimental to the subsequent formation of satisfactory combustible carbon rods. Formation of the cellulosic paper rods is typically conducted in an oxygen-containing atmosphere.

The cellulosic paper rods may be made as a continuous rod or in specifically defined lengths. If the rods are made in specifically defined lengths, the lengths should be in excess of the length of the combustible carbon filter or combustible carbon segment required in the final smoking product.

The combustible carbonized rods are produced by containing the cellulose rods with an additive and then advancing the treated cellulose rods through a heated die in an oxygen-free atmosphere to pyrolyze the cellulose rod and produce a combustible carbonized rod.

The cellulose rod, as noted above, typically contains the additive in the aforementioned effective amounts as the binding agent. However, where the additive has not been employed as the binding agent, the additive may be applied by spraying the cellulose rod with a solution of the additive, preferably an aqueous solution, and then drying the treated rod to remove the solvent. The additive is applied in an amount such that the treated cellulose rod contains from about 1% to about 5% by weight of the additive on a dry weight basis.

When cellulose is pyrolyzed, gaseous material, aerosolized particulate matter (TPM) and char are the major products. The char is the carbon. By adding various compounds to the cellulose before pyrolysis, the proportion of these major products may be adjusted so that more of one and less of the others is produced. It is desired to maximize the amount of char produced and to minimize the weight loss of the cellulose rod during pyrolysis. Certain compounds have been discovered which, when applied to the cellulose rod in the aforementioned concentrations prior to pyrolysis, result in the production of a greater amount of char than is produced when these additives are not present and tend to decrease the amount of weight loss during pyrolysis. Decreases in weight loss generally correspond to increases in rod strength.

The additive is a compound selected from the group consisting of $Na_2B_4O_7$, $CaCl_2$, $K_4Fe(CN)_6$, $Al_2(SO_4)_3$ and $Cu_2SO_4$ and mixtures thereof. Preferably the additive is a compound selected from the group consisting of $Na_2B_4O_7$, $K_4Fe(CN)_6$ and mixtures thereof. A particularly preferred additive is sodium tetraborate ($Na_2B_4O_7$). When combinations of the additives are applied, the total concentration of the additives in the treated rod is within the aforementioned range. As noted above, the additive may be employed as a binding agent in the formation of the cellulose rod. When the additive is employed as the binding agent, subsequent treatment of the cellulose rod with the additive is omitted.

The treated cellulose rod is then pyrolyzed by being advanced through a heated die. This may be done as a continuous process, or individual rods of preselected length may be so treated. The die is maintained at a substantially constant temperature within the range of from about 500° C. to about 1000° C. The heat treatment time (retention time in the die) is at least about 3 seconds, preferably about 3 seconds to about 1 minute. The additive concentration, the treatment temperature and the treatment time are selected to minimize weight loss and maximize the amount of char or carbon produced. At least about 15% by weight of the cellulose rod remains after treatment, preferably at least about 20% by weight, and more preferably from about 15% to about 40% by weight.

The die through which the treated cellulose rod is passed is preferably a tapered die in order to achieve controlled compaction of the entering strand as it undergoes pyrolysis. The die provides a precise outer periphery of the carbonized rod and may be of any reasonable length. The die is maintained at a substantially constant temperature by conventional means such as by thermostatically controlled electric resistance elements.

The atmosphere at the inlet end of the die and at the outlet end of the die is free of oxygen. If oxygen is present at the inlet end of the die, the cellulosic paper rod will tend to ignite upon contact with the heated die. If oxygen is present at the outlet end of the die, the carbonized rod which is at an elevated temperature upon emergence from the die will tend to burn upon contact with the oxygen. The oxygen-free atmosphere may be established by placing the die in a chamber into which an inert gas, such as nitrogen, is introduced under a positive pressure to exclude oxygen from the chamber. The oxygen-free environment may also be provided by the gaseous products of pyrolysis which may be drawn off and recovered for their fuel value.

The carbonized rod is maintained in an oxygen-free atmosphere while it is rapidly cooled to a temperature of less than about 250° C. Cooling the carbon rod to temperatures much below 250° C. is not necessary and it is not contemplated that the carbon rod will be cooled to less than room temperature. The cooled rod is then advanced into an oxygen-containing atmosphere.

The die is selected such that the diameter of the pyrolyzed cellulose rod emerging from the die is preferably within the range of from about 7 mm to about 9 mm, which is the diameter of a conventional cigarette. The treated cellulose rod entering the die is at least about 11 mm in diameter but, upon contacting the heated die, the diameter rapidly decreases due to the weight loss incident to pyrolysis.

Following its formation, the combustible carbonized rod may optionally be subjected to an activation treatment by partial oxidative erosion at temperatures in the range of 750°–1050° C. Activation produces a high surface area which is capable of selectively absorbing certain smoke components.

Catalytic species, such as active metals and metal oxides, metal salts and other agents to modify burning characteristics and smoke composition, can be incorporated into the carbonized rod by application either prior to or after pyrolysis. Flavoring agents or other ingredients may be applied to the combustible carbonized rod by spraying, dipping, or other known methods to enhance its smoking characteristics.

The internal configuration of the combustible carbonized rod, as shown in FIGS. 1 and 2, is characterized by the presence of random folds, running generally parallel to the rod axis and thus retains the geometry of the cellulose rod. The carbonized rod is further distinguished by the fact that a portion of the individual fibers that constitute the structure are aligned in directions transverse to the longitudinal axis of the rod.

Microscopic examination of the carbonized rod reveals retention of the general fibrillar configuration of the precursor cellulosic rod with the exception that some of the extremely fine fibrous appendages of the paper pulp particles are missing. There is also carbonized material which appears to bond the fibrous elements together. Such bonding material is thought to derive from the tar-like pyrolyzate generated during pyrolysis as well as from carbonization of the binding agent. Because of the particular apparatus and process utilized, the pyrolyzate is permitted to condense on the fibers in cooler regions of the rod upstream from the heated die. The condensed pyrolyzate then undergoes carbonization to form rigid bridging between fibers. This self-generated or autogenous carbonized bonding material improves the structural integrity of the combustible carbonized rod, and increases its flexural strength.

The flexural strength of the carbonized rod should be adequate to facilitate machine handling in the production of cigarettes. For the purpose of this invention, it has been found expedient to measure the flexural strength by horizontally supporting a specimen at two points located 36.5 mm apart and determining the amount of downwardly applied force needed to break the rod at the center of its span. An Instron Tensile Tester (made by the Instron Engineering Corp., Canton, MA) coupled to a strip chart recorder was utilized to determine the applied force. The rate of downward movement of the force-applying member is 5 cm/min., and the chart speed is 10 cm/min. When measured in this manner, it is found that, in order to possess adequate strength for use in cigarette fabrication, the carbonized rod should possess a flexural strength greater than 4 grams and preferably greater than 10 grams.

The nature of the porosity of the carbonized rod is such that the rod contains greater than 60 percent and preferably greater than 80 percent volume of interconnecting void space as measured by the method of Hartung and Dwyer reported in Paper #10 of the Tobacco Chemists Research Conference, October 1974. The percentage of open volume within a carbonized rod may also be ascertained by determining the volume of solid material within the rod using an air pycnometer and comparing this value with the total or envelope volume of the rod structure. It is believed that weight loss is generally related to the present of pore volume. Pore volumes in excess of 98.5%, although potentially desirable for smoking considerations, are associated with unsatisfactorily low rod strength.

The carbonized rod produced according to the method of the present invention is combustible and exhibits properties of filtration which are superior to those of conventional cellulose acetate filters in that the combustible carbon filters of the present invention, trap more TPM than the cellulose acetate filters. When incorporated in a tobacco-containing cigarette, the carbon filter traps TPM and then, when the coal reaches the carbon filter, it burns in a manner resembling the tobacco column but releases no TPM of its own and little of the trapped, condensed TPM produced by the combustion of the tobacco column. The combustible carbon filter thus permits the manufacture of what may be referred to as a controlled profile tobacco-containing cigarette wherein the last few puffs may be perceived by the smoker to be as mild as the initial puffs.

The carbonized rod, when employed as a filter, will preferably have a length of from about 10 mm to about 40 mm and may be employed in conjunction with a conventional filter such as a cellulose acetate filter, which conventionally are from about 10 mm to about 25 mm in length, preferably in abutting end-to-end relationship thereto and intermediate the tobacco column and the conventional filter as shown in FIG. 1, or may be spaced therefrom. When spaced from the conventional filter, the space between the two filters may be a void or may contain tobacco. With dual filter cigarettes, such as is shown in FIG. 1, an 80% reduction in TPM delivery has been obtained. The carbon filter may also be employed as the sole filter in a tobacco-containing cigarette and as such may be located at the mouth end of the cigarette, as is a conventional filter, or may be placed intermediate the ends of the cigarette with tobacco columns on either side of it as shown in FIG. 2.

The combustible carbonized rod of the present invention may also be employed as a tobacco-free smoking product by cutting the carbonized rod to a conventional cigarette length, that is, from about 85 mm to about 120 mm, adding tobacco flavors thereto and then wrapping it with a conventional cigarette wrapping paper. The tobacco-free smoking product burns readily, producing an ash. The combustible carbonized rod may, in fact, contain about 20 to about 50 percent by weight of ash-forming materials.

We claim:

1. A method of making a combustible carbonized rod for use in a smoking product comprising:

contacting cellulosic paper made by the wet papermaking process with an aqueous solution of a binding agent;

repeatedly folding the wet paper along its longitudinal axis to form a substantially cylindrical bundle;

advancing the substantially cylindrical bundle through a heated die to remove the water and produce a coherent cellulose rod which maintains its integrity in the absence of any external wrapping, said die being selected such that the cellulose rod emerging therefrom has a diameter of at least about 11 mm;

treating the resulting unwrapped cellulose rod with an additive selected from the group consisting of $Na_2B_4O_7$, $CaCl_2$, $K_4Fe(CN)_6$, $Al_2(SO_4)_3$ and $Cu_2SO_4$ and mixtures thereof so that the treated cellulose rod contains from about 1% to about 5% by weight of the additive on a dry weight basis;

pyrolyzing the treated cellulose rod by advancing said treated cellulose rod through a die maintained at a temperature within the range of from about 500° C. to about 1000° C. in an oxygen-free atmosphere for a total retention time in the die of from about 3 seconds to about 1 minute, said die being selected such that the pyrolyzed rod emerging therefrom has a diameter of from about 7 mm to about 9 mm; and cooling the pyrolyzed rod to less than about 250° C. before removing the pyrolyzed rod from the oxygen-free atmosphere.

2. The method of claim 1 wherein the additive is a compound selected from the group consisting of $Na_2B_4O_7$, $K_4Fe(CN)_6$ and mixtures thereof.

3. The method of claim 2 wherein the additive is $Na_2B_4O_7$.

4. The method of claim 1 wherein the pyrolyzed rod retains at least about 20% of the weight of the cellulose rod.

5. The method of claim 4 wherein the pyrolyzed rod retains from about 20% to about 40% of the weight of the cellulose rod.

6. The method of claim 1 wherein the binding agent is a water soluble polymer.

7. The method of claim 1 wherein the die is selected such that the cellulose rod emerging therefrom has a diameter of from about 11 mm to about 17 mm.

8. A carbon filter for use in a smoking product comprising a combustible carbonized rod made according to the method of claim 1, said rod having a length of from about 10 mm to about 40 mm.

9. A tobacco-containing filter cigarette wherein the filter is the carbon filter of claim 8.

10. The cigarette of claim 9 including a conventional filter located at the mouth end of the cigarette and wherein the carbon filter is located between the conventional filter and the tobacco.

11. The cigarette of claim 10 wherein the conventional filter is a cellulose acetate filter.

12. A tobacco-free cigarette comprising a combustible carbonized rod made according to the method of claim 1 impregnated with tobacco flavor and a cigarette paper wrapper surrounding said impregnated rod, said rod having a length of from about 85 mm to about 120 mm.

13. A method of making a combustible carbonized rod for use in a smoking product comprising:

contacting cellulosic paper made by the wet papermaking process with an aqueous solution of an additive selected from the group of compounds consisting of $Na_2B_4O_7$, $CaCl_2$, $K_4Fe(CN)_6$, $Al_2(SO_4)_3$ and $Cu_2SO_4$ and mixtures thereof so that the paper contains from about 1% to about 5% by weight of the additive on a dry weight basis, repeatedly folding the wet paper along its longitudinal axis to form a substantially cylindrical bundle, advancing the substantially cylindrical bundle through a heated die to remove the water and produce a coherent cellulose rod which maintains its integrity in the absence of any external wrapping, said die being selected such that the cellulose rod emerging therefrom has a diameter of at least about 11 mm, pyrolyzing the treated cellulose rod by advancing said treated cellulose rod through a die maintained at a temperature within the range of from about 500° C. to about 1000° C. in an oxygen-free atmosphere for a total retention time in the die of from about 3 seconds to about 1 minute, said die being selected such that the pyrolyzed rod emerging therefrom has a diameter of from about 7 mm to about 9 mm, and cooling the pyrolyzed rod to less than about 250° C. before removing the pyrolyzed rod from the oxygen-free atmosphere.

* * * * *